US010023363B2

(12) United States Patent
Ciccone

(10) Patent No.: US 10,023,363 B2
(45) Date of Patent: Jul. 17, 2018

(54) LID AND CONTAINER ASSEMBLY

(71) Applicant: INJECTNOTECH INC., Mississauga (CA)

(72) Inventor: Vince Ciccone, Ontario (CA)

(73) Assignee: INJECTNOTECH, INC., Mississauga, Ontario (CA)

( * ) Notice: Subject to any disclaimer, the term of this patent is extended or adjusted under 35 U.S.C. 154(b) by 617 days.

(21) Appl. No.: 14/032,270

(22) Filed: Sep. 20, 2013

(65) Prior Publication Data

US 2014/0076899 A1 Mar. 20, 2014

Related U.S. Application Data

(60) Provisional application No. 61/703,445, filed on Sep. 20, 2012.

(51) Int. Cl.

*B65D 41/48* (2006.01)
*B44D 3/12* (2006.01)
*B65D 43/02* (2006.01)

(52) U.S. Cl.

CPC ..... *B65D 41/48* (2013.01); *B44D 3/12* (2013.01); *B65D 43/0206* (2013.01); *B65D 2543/00092* (2013.01); *B65D 2543/00296* (2013.01); *B65D 2543/00564* (2013.01); *B65D 2543/00629* (2013.01); *B65D 2543/00694* (2013.01);

(Continued)

(58) Field of Classification Search

CPC ..... B65D 43/0206; B65D 43/0204; B65D 43/021; B65D 43/0216; B65D 43/0229; B65D 2543/00694

USPC ..... 220/790

See application file for complete search history.

(56) References Cited

U.S. PATENT DOCUMENTS 3,638,821 A 2/1972 Guala
3,977,563 A 8/1976 Holt (Continued)

FOREIGN PATENT DOCUMENTS

DE 8908076 U1 8/1989
EP 0455172 A2 11/1991
GB 2251431 A 7/1992

*Primary Examiner* — Anthony Stashick
*Assistant Examiner* — Robert Poon
(74) *Attorney, Agent, or Firm* — William J. Clemens; Shumaker, Loop & Kendrick, LLP

(57) ABSTRACT

A thermoplastic container assembly includes an improved means of attachment between lid, base and container which meets paint industry drop test standards and includes tamper evidence, a transparent lid and improved means to prevent leakage between the base, lid and container. The container includes an upper extending tubular wall element extending from the perimeter of a bottom wall to an upper rim, the upper rim including an annular inward facing cavity formed by a reduced thickness area, which includes an annular inward facing upper bead positioned above the inward facing cavity. A base includes an annular portion having an outwardly directed resilient exterior annular wall which engages the inward facing cavity of the rim of the tubular element in snap fit engagement. A lid includes a plurality of spaced apart resilient flange/protrusion elements extending outwardly from a bottom portion of an annular portion of the lid; the flanges/protrusion elements being snap-fit engageable within an upward facing annular groove of the base.

19 Claims, 12 Drawing Sheets

(52) U.S. Cl.
CPC ..... *B65D 2543/00731* (2013.01); *B65D 2543/00805* (2013.01); *B65D 2543/00898* (2013.01)

(56) References Cited

U.S. PATENT DOCUMENTS

| | | | | | |
|---|---|---|---|---|---|
| 4,201,311 | A * | 5/1980 | Underwood | B65D 21/0222 | 220/780 |
| 4,358,024 | A | 11/1982 | Underwood | | |
| 4,577,776 | A | 3/1986 | Rayner et al. | | |
| 4,619,373 | A | 10/1986 | Galer | | |
| 4,667,842 | A | 5/1987 | Collins | | |
| 4,887,735 | A | 12/1989 | Dudzik | | |
| 5,161,711 | A | 11/1992 | Picozza et al. | | |
| 5,181,626 | A | 1/1993 | Daenen et al. | | |
| 5,785,201 | A * | 7/1998 | Bordner | B65D 43/0218 | 206/508 |
| 6,772,904 | B1 | 8/2004 | Gilliam et al. | | |
| 6,851,569 | B2 * | 2/2005 | Conti | B65D 21/0219 | 215/216 |
| 8,052,004 | B2 * | 11/2011 | Cheng | B65D 43/0202 | 215/275 |
| 2008/0190803 | A1 | 8/2008 | Blumenschein | | |
| 2011/0186572 | A1 * | 8/2011 | Ciccone | B65D 25/28 | 220/212.5 |

* cited by examiner

LID AND CONTAINER ASSEMBLY

CROSS-REFERENCE TO RELATED APPLICATION

This application claims the benefit of and priority to U.S. Provisional Patent Application No. 61/703,445 filed Sep. 20, 2012 under the title LID AND CONTAINER ASSEMBLY.

The content of the above patent application is hereby expressly incorporated by reference into the detailed description hereof.

FIELD OF INVENTION

This invention relates to a thermoplastic container assembly comprising a container, a base and a removable lid. The assembly includes an improved means of attachment between lid, base and container which meets paint industry drop test standards and may further include tamper evidence, a transparent lid and improved means to prevent leakage between the base, lid and container.

SUMMARY OF INVENTION

In accordance with an aspect of the invention, there is provided a container and lid assembly comprising: a container including an upper extending tubular wall element extending from the perimeter of a bottom wall to an upper rim at the upper portion thereof defining an interior containing space, the upper rim including an annular inward facing cavity formed by a reduced thickness area, the upper rim further including an annular inward facing upper bead positioned above the inward facing cavity; a base including an annular portion having an outwardly directed resilient exterior annular wall which engages the inward facing cavity of the rim of the tubular element in snap fit engagement; wherein as the annular exterior wall of the base enters the cavity in the rim of the tubular element, the bead deforms the exterior annular wall inwardly, and as the exterior wall of the base enters the cavity in snap fit engagement, the exterior wall returns to its normal position; the annular portion of the base including an upward facing annular groove extending around the entirety thereof. A lid includes a plurality of spaced apart resilient flange/protrusion elements extending outwardly from a bottom portion of an annular portion of the lid; the flanges/protrusions being snap-fit engageable within the upward facing annular groove of the base.

In accordance with a further aspect of the invention, the upward facing annular groove of the base is defined by an interior upright wall, a bottom wall and a slightly obtusely angled exterior wall, the exterior wall including an inward protrusion/bead extending around the upper end thereof, and each flange/protrusion of the lid has a bottom portion which extends outwardly from the circumferential edge of the lid and an upwardly extending resilient slightly obtusely angled outer wall, and as the lid is pressed upon the annular portion of the base, the upwardly extending resilient outer wall of each flange/protrusion element is deformed inwardly as it enters the top of the upward facing annular groove of the base by the inward protrusion/bead, and then once within the groove, returns back to its obtusely angular position thereby securing the lid in position within the groove.

In accordance with a further aspect of the invention, in at least one of the spaces between the flange/protrusion elements, positioned on an upper portion of the annular portion of the lid a prying flange extends outwardly from an outer annular portion of the lid.

In accordance with yet a further aspect of the invention, the upper portion of the tubular element of the container includes an inward facing ledge upon which a bottom portion of the exterior wall of the base locates when the outwardly directed resilient exterior annular wall is snap fit into engagement within the annular inward facing cavity in the tubular wall element. In accordance with yet a further aspect of the invention, the ledge comprises an upwardly angled molded flexible wiper protuberance extending inwardly therefrom and optionally a second flexible wiper protuberance above the ledge, wherein the flexible wiper protuberance on the ledge engages with the bottom of the exterior annular wall of the base, and the second flexible wiper protuberance above the ledge flexes against an outer side of the exterior wall, each creating a seal to act as barriers to prevent the contents of the interior containing space of the container from leaking between the rim of the container and the base. As an alternative, the container presented herein may use only one of the flexible wiper protuberances.

In accordance with yet a further aspect of the invention, the base includes an interior horizontal panel covering the entirety of the container when the base is secured upon the container, and the interior horizontal panel includes a circumferential strip defined by lines of reduced thickness extending around the perimeter of the base panel, inward and adjacent to the annular portion, having a pull ring or a pull tab secured to an end of the strip which a user may grab and pull thereby causing the strip to tear off and the interior horizontal panel to be removed, creating tamper evidence.

In accordance with yet a further aspect of the invention, adjacent the point of attachment of the pull ring or pull tab to the tear strip, there may be positioned a groove and an adjacent protrusion with an opening into which a screw driver or other comparable implement may be inserted and/or twisted to initiate a tear at the end of the tear strip. This aspect of the invention is contemplated for use with industrial applications where manual pulling force on the pull ring or pull tab is insufficient to initiate a tear at the end of the tear strip.

In accordance with an aspect of the invention, the lid is transparent and the container and base are typically non-transparent, and/or made of recycled materials.

In accordance with an aspect of the invention, the base includes a central opening rather than a horizontal panel.

In accordance with an aspect of the invention, the lid is additionally or alternately adapted to be secured directly to the upper rim of the container, the lid including a downwardly facing resilient tubular wall having an inwardly facing protrusion at the bottom end thereof adapted to fit over the upper rim of the container and engage in a snap fit with an outwardly facing cavity positioned on the outer surface of the tubular wall of the container. The lid may be removed from its engagement with the upper rim of the container by pulling the downwardly facing tubular wall outwardly with a finger or flat ended implement to disengage the inwardly facing protrusion from the outwardly facing cavity as the lid is pulled off the container, thus exposing the tamper evident base panel.

DESCRIPTION OF THE DRAWINGS

For a fuller understanding of the nature and objects of the invention, reference should be made to the following detailed description taken in conjunction with the accompanying drawings, in which.

DETAILED DESCRIPTION OF EXAMPLE EMBODIMENTS OF INVENTION

Figure 1A:
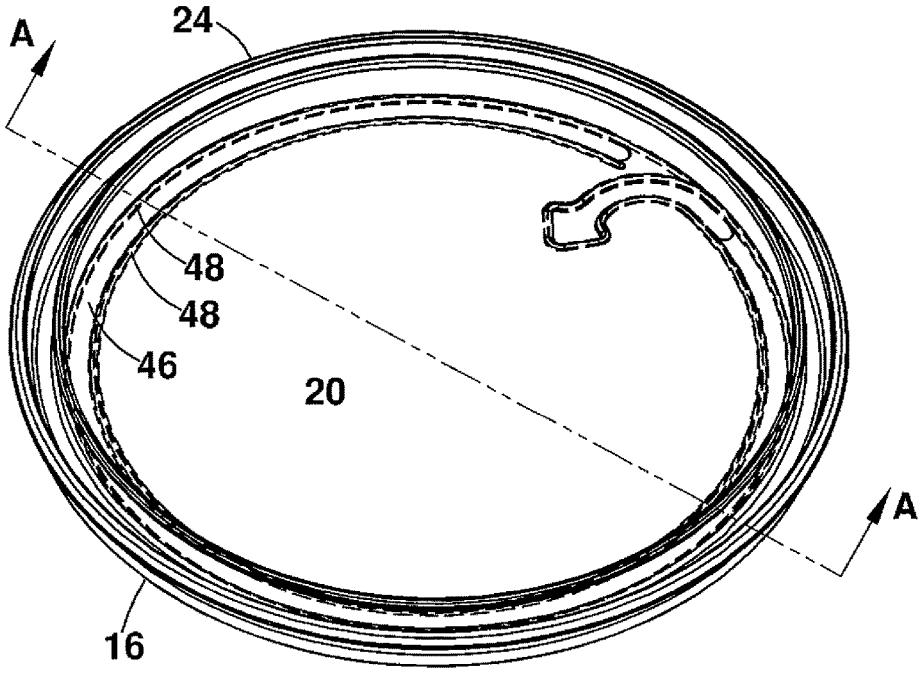
FIG. 1A is a perspective view of the base in accordance with an embodiment of the invention.

In an example embodiment of the invention, a container 10 has an upper extending tubular wall element 12 extending from the perimeter of a bottom wall 14 defining an interior containing space. The container is preferably made of thermoplastic material. A base 16 is attachable to the upper rim 18 of the upper extending tubular wall element 12 of the container.

Figure 2:
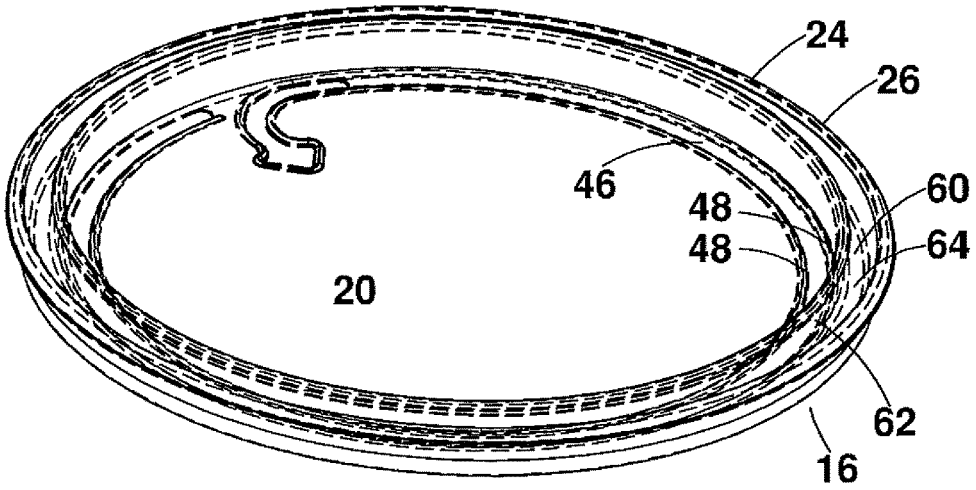
FIG. 2 is a perspective view of the base in accordance with an embodiment of the invention, with tamper evident feature.
Figure 4:
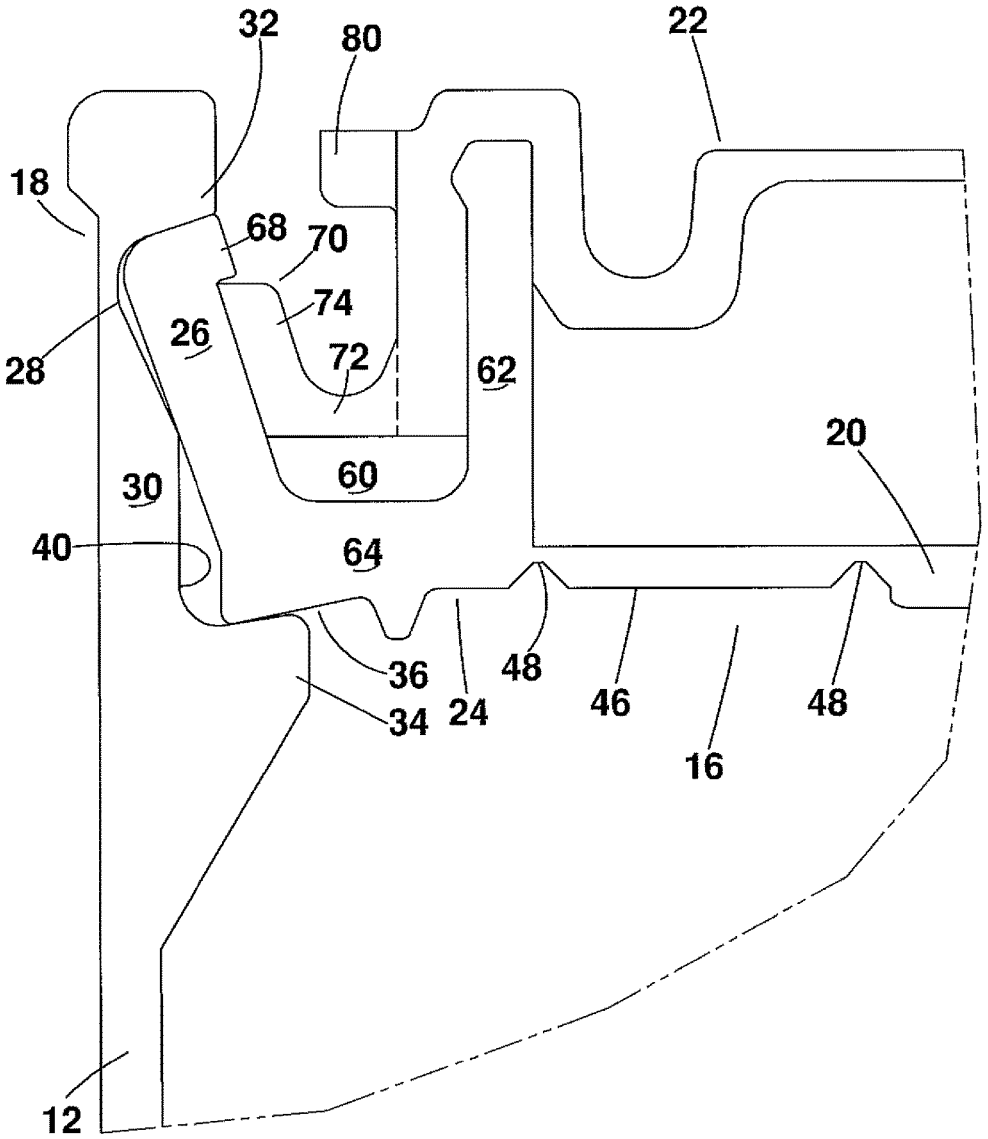
FIG. 4 is a cross-sectional close up view of the point of attachment of the lid, base and rim of container in accordance with an example embodiment of invention.
Figure 4A:
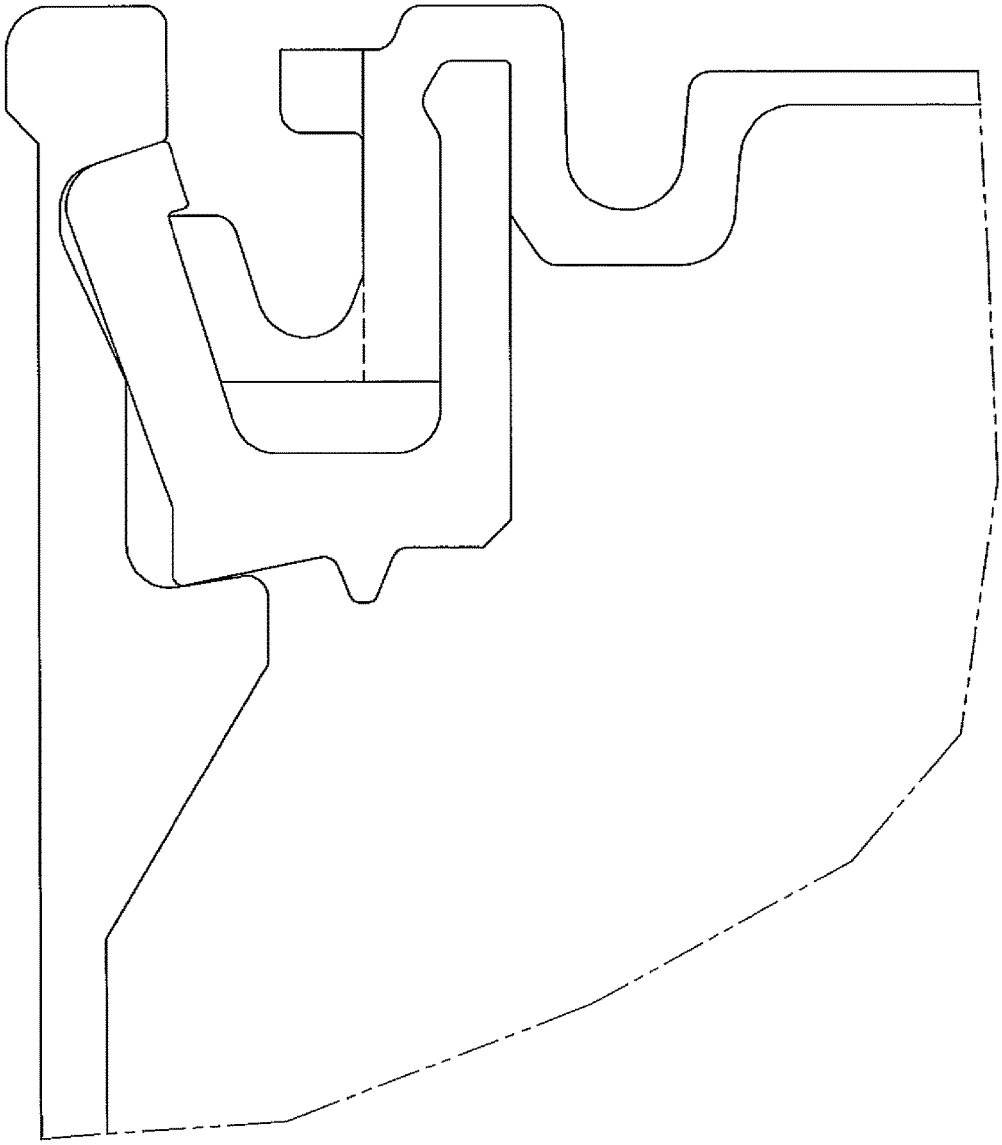
FIG. 4A is a cross-sectional close up view of the point of attachment of the lid, base and rim of container in accordance with an alternate embodiment of invention, the base including a central opening rather than a horizontal panel.
Figure 5:
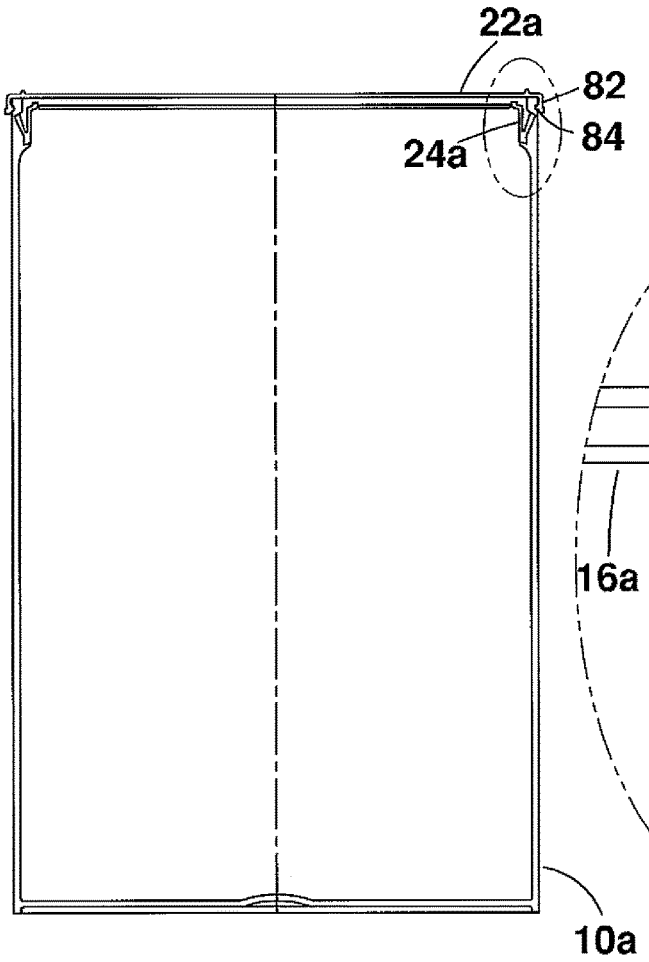
FIG. 5 is a cross-section view of an alternate embodiment of the invention, presenting a lid adapted to be secured directly to the upper rim of the container.
Figure 5A:
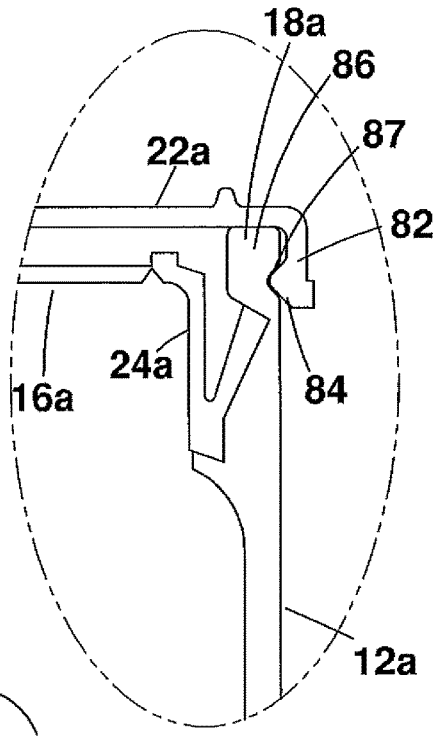
FIG. 5A is a close up view of the portion of FIG. 5 marked in chain-dot circle.

As will be set out below, in an example embodiment of the invention, base 16 includes a tamper evident feature on an interior horizontal panel 20 as shown in FIG. 2 and FIG. 4, and is adapted to accept a removable lid 22 in a sufficiently strong attachment to meet paint industry drop test standards. In an alternate embodiment of the invention shown in FIG. 4A, the base does not have an interior horizontal panel, but rather defines a central opening. In an alternate embodiment, the lid 22*a* may be secured directly to the upper rim 18*a* of the tubular wall of the container 10*a* as shown in FIGS. 5 and 5A (discussed below).

In an example embodiment the lid 22 is transparent.

The base 16 creates a permanent seal to the upper rim 18 of the tubular wall element 12 as follows: The base includes an annular portion 24 including an outwardly directed resilient exterior annular wall 26 which engages a mating annular inward facing cavity 28 extending around the rim 18 of an upper portion 30 of the tubular wall element 12 of the container in snap fit engagement. The annular cavity 28 in the wall of the container is formed by a reduced thickness area, positioned immediately below an annular upper bead 32, positioned in an inwardly biased position. As the exterior annular wall 26 of base 16 enters cavity 28 in the rim of tubular wall element 12, bead 32 tends to inwardly deform the resilient exterior annular wall 26 of base 16 and itself be deformed outwardly, and then once the exterior annular wall 26 enters cavity 28, the resilient exterior annular wall returns to its normal position and bead 32 returns to an inwardly biased position.

The upper portion 30 of tubular wall element 12 may also include an inward facing ledge 34 upon which a bottom portion 36 of the exterior annular wall of the base locates when the outwardly directed resilient exterior annular wall 26 is snap fit into engagement within cavity 28 in the tubular wall element 12. In the embodiment shown in the figures, the bottom portion 36 of the exterior wall of the base is angled downwardly as it extends outwardly and mates with the matching-shaped inward facing ledge 34 on the inside of tubular wall element 12.

Figure 6A:
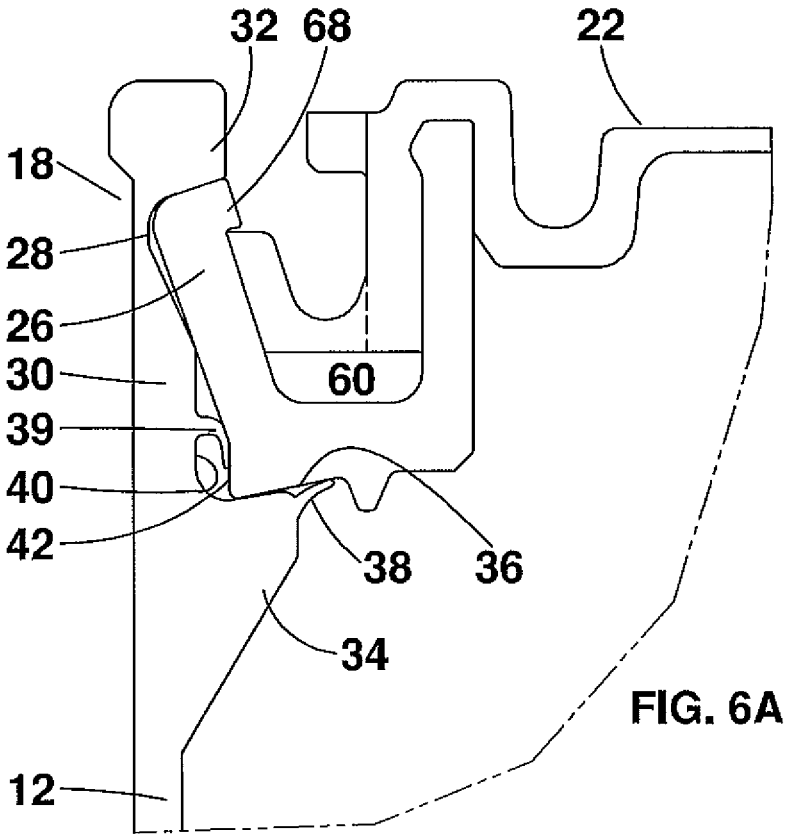
FIG. 6A is a sectional view of the upper periphery of the container assembly illustrating attachment of lid, base and rim of container for an example embodiment of the invention with container with ledge and molded flexible wiper protuberances.
Figure 6B:
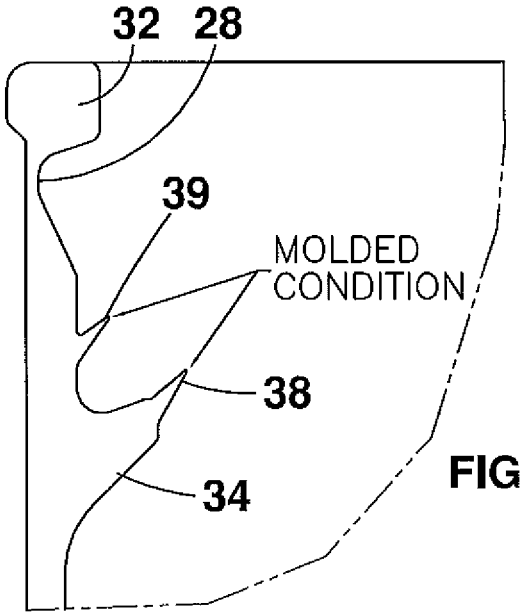
FIG. 6B is a close up sectional view of the upper periphery of the container of FIG. 6A.

In a further alternate embodiment shown in FIGS. 6A and 6B, ledge 34 comprises an upwardly angled molded flexible wiper protuberance 38 extending inwardly therefrom. A second flexible wiper protuberance 39 is also present above the ledge on an inner side wall 40 of the tubular wall element 12. The flexible wiper protuberance 38 on ledge 34 engages the bottom portion 36 of the exterior annular wall of the base, and the second flexible wiper protuberance 39 flexes against an outer side 42 of the exterior annular wall 26, each creating a seal to act as barriers to prevent the contents of the interior containing space of the container from leaking between the rim of the container and base. As embodiments shown are typically designed for use to store paint, the prevention of leakage of paint during transport and during the process of removal of the lid from base and/or directly from the rim of the container is desirable. It should be understood that although example embodiments of the container and lid assemblies of the invention are designed for use to store paint, the invention may be used to store any material, including but not limited to liquids of varying viscosities, food and beverage products, powders and solid materials. As an alternative, the container presented herein may use only one of the flexible wiper protuberances (38 or 39) presented above.

In an example embodiment of the invention as shown in FIG. 4, a tamper evident feature is present upon the base. In this embodiment, base 16 includes a continuous interior horizontal panel 20 inward of the annular portion 24. A circumferential tear strip 46 extends around the perimeter of the interior horizontal panel, inward and adjacent to the annular portion 24. The strip is defined by parallel lines of weakened/reduced thickness 48.

To activate the tear strip, the interior horizontal panel 20 of the base may include a pull-ring or pull-tab (not shown) on its outer surface secured to an end (preferably at an inwardly directed portion) of the strip upon which a user may grab and pull, thereby causing the strip to tear off and create the tamper evidence. With the tear strip removed, the interior horizontal panel of the base is removed, thereby forming an opening into the containing space interior to the annular portion of the base as part of the tamper evident feature of the container assembly.

In an alternate embodiment of the invention, the base does not have a central panel but rather defines a central opening by the annular portion, securable to the wall of the container described above.

In an example embodiment such as shown in FIG. 4, a removable lid 22 (which may or may not be transparent) is attachable to the annular portion of the base with an improved method of attachment as described below:

The annular portion 24 of the base includes an upward facing annular groove 60 extending around the entirety thereof, defined by an interior upright wall 62, a bottom wall 64 and the upright or slightly obtusely angled exterior wall 26. The exterior wall includes an inward protrusion/bead 68 extending around the upper end thereof.

In this embodiment of the base as described above, the exterior annular wall 26 of the base engages in snap fit engagement with the mating annular inward facing cavity 28 defined in the upper portion of the tubular wall element 12 of the container to create the permanent seal between the base and the container.

Figure 1B:
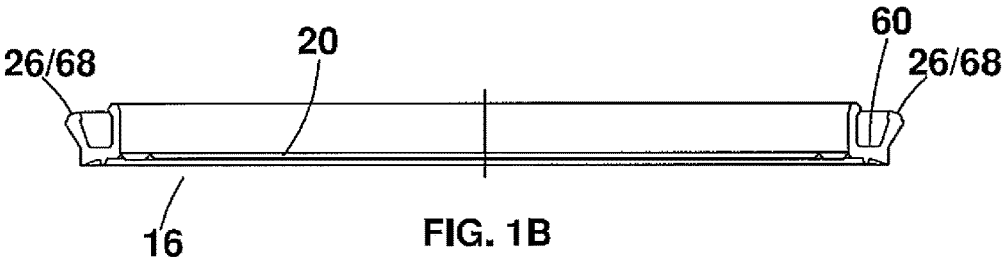
FIG. 1B is a section view of the base of FIG. 1A along line A-A.
Figure 1D:
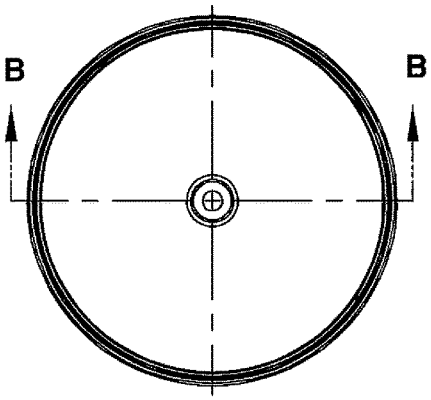
FIG. 1D is a top view of the container of FIG. 1C.
Figure 1C:
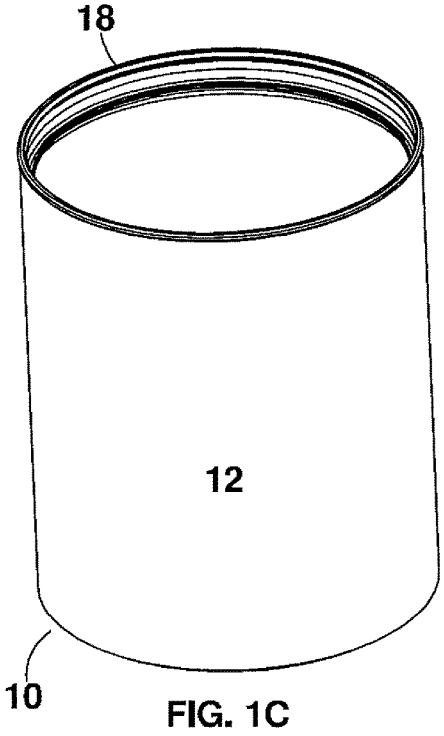
FIG. 1C is a perspective view of a container in accordance with an embodiment of the invention.
Figure 1E:
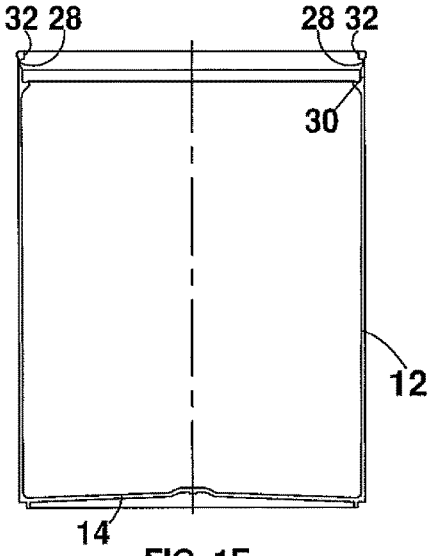
FIG. 1E is a section view taken along line B-B of FIG. 1D.
Figure 3:
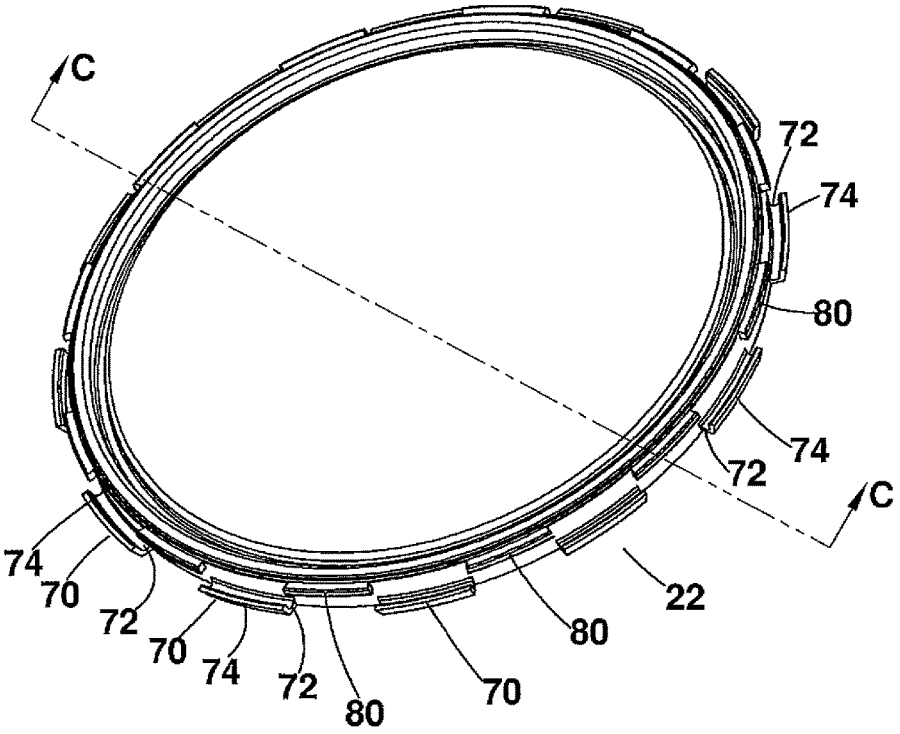
FIG. 3 is a perspective view of a lid in accordance with an example embodiment of the invention.
Figure 3A:
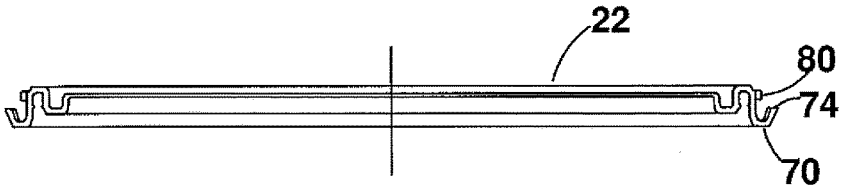
FIG. 3A is a section view of the lid of FIG. 3 taken along line C-C.

The lid seen in FIGS. 3 and 3A, which in particular embodiments is transparent, includes at least one and preferably a plurality of spaced apart flange/protrusion elements 70 extending outwardly from a bottom portion of an annular portion of the lid. Each flange/protrusion has a bottom portion 72 which extends outwardly from the circumferential edge of the lid and an upwardly extending resilient slightly obtusely angled outer wall 74. The lid is adapted such that the flanges/protrusions 70 may be snap fit into engagement within the upward facing annular groove 60 extending around the circumference of the annular portion of the base. As the lid is pressed upon the annular portion of the base, the outer resilient wall 74 of each flange/protrusion element is deformed inwardly as it enters the top of the annular groove by the inward protrusion/bead 68 extending around the top of the groove, and then once within the groove, returns back to its obtusely angular position thereby securing the lid in position within the groove 60. In the embodiment shown in FIGS. 1A and 1B, bead 68 extends continuously around the upper end of exterior annular wall 26, but it should be understood that an interrupted bead 68 is also contemplated by this invention.

When the flange/protrusion elements 70 of the lid are positioned in the upward facing annular groove 60 of the base annular portion 24, the flange elements act to further strengthen the force of attachment of the base 16 to the rim 18 of the container as the flange/protrusion elements tend to push the exterior wall 26 of the base annular portion against the rim 18 of the tubular wall element 12. In certain embodiments of the invention, this further causes the reduced thickness area in the upper portion 30 of tubular wall element 12 to tend to be pushed outwardly, thereby causing the bead 32 immediately above to further bias inwardly, thereby improving the strength of attachment.

In at least some and preferably in each of the spaces between the flange/protrusion elements 70, positioned on the annular portion of the lid are a plurality of prying flanges 80, extending outwardly from the outer annular portion of the lid. In the example shown the prying flanges are positioned on an upper portion of the annular portion of the lid. Lid 22 may be removed from the groove in the annular portion of the base by means of inserting a flat implement under a prying flange 80 and then prying the lid off the container/annular portion of the base.

Preferably the lid includes 12 flanges/protrusions 70 and 12 prying flanges 80, with the spacing of the flange/protrusion elements being such that the distance between consecutive flanges is approximately the same as the length of each flange. Variations in the number and length of the prying flanges and flange elements is contemplated by this invention.

Shown in FIGS. 5 and 5A is an alternate embodiment of the container assembly, the lid 22*a* including a downwardly facing resilient tubular wall 82 having an inwardly facing protrusion 84 at the bottom end thereof adapted to fit in an outwardly facing cavity 87 on the outer surface of the tubular wall of the container 10*a*. This alternate embodiment of the lid is adapted to fit over the annular portion 24*a* of the base 16*a* and engage in a snap fit over an outwardly facing bead 86 positioned on an upper portion of the tubular wall of the container. The lid may be removed from its engagement with the tubular wall element by pulling the downwardly facing resilient tubular wall 82 outwardly with a finger or flat ended implement to disengage the bead as the lid is pulled off the container. The features of FIGS. 5 and 5A may be present in addition or alternate to those of the lid of alternate embodiments.

The engagement of the lid to the annular portion of the base in the first embodiment creates a sufficiently strong attachment to satisfy paint industry drop tests for standard size paint cans. The engagement of the lid directly to the tubular wall element of the container in the alternate embodiment creates a satisfactory attachment for applications with less stringent requirements.

Figure 7A:
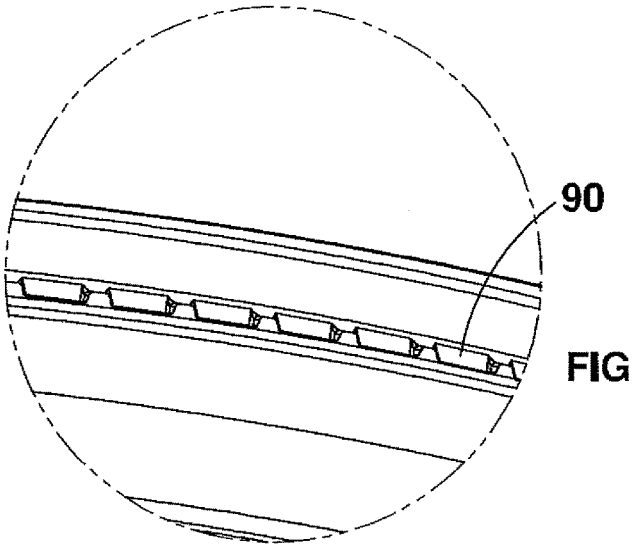
FIG. 7A is a close up view of the portion of FIG. 7 marked in chain-dot circle.
Figure 7:
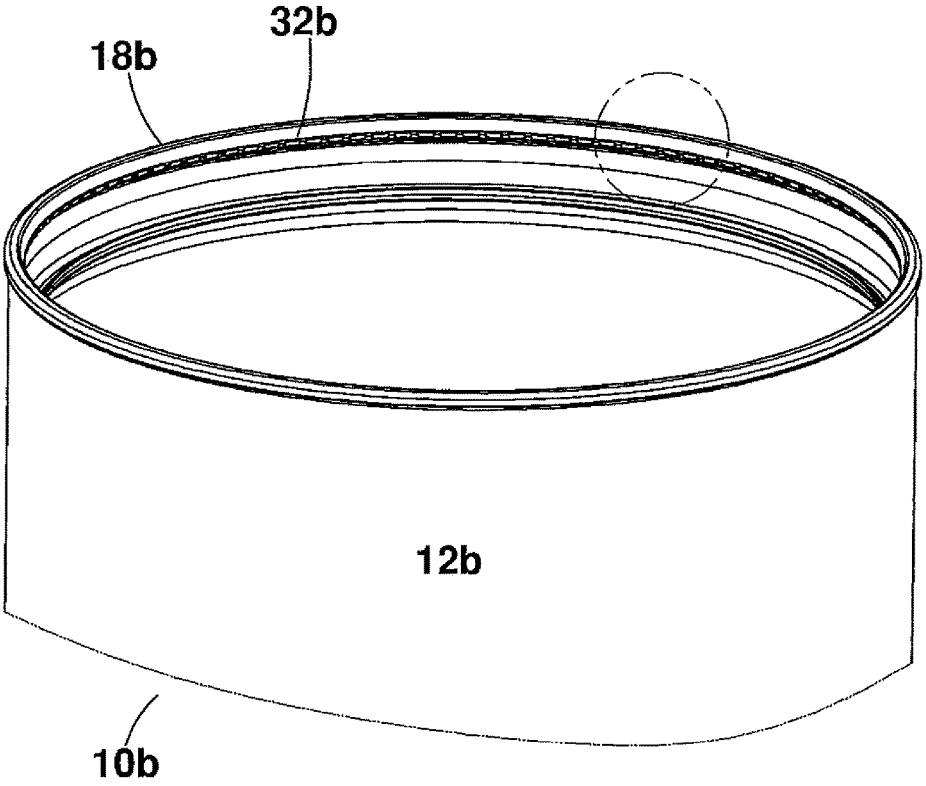
FIG. 7 is a perspective view of a container in accordance with an alternate embodiment of the invention presenting teeth on the circumference of the container.
Figure 8:
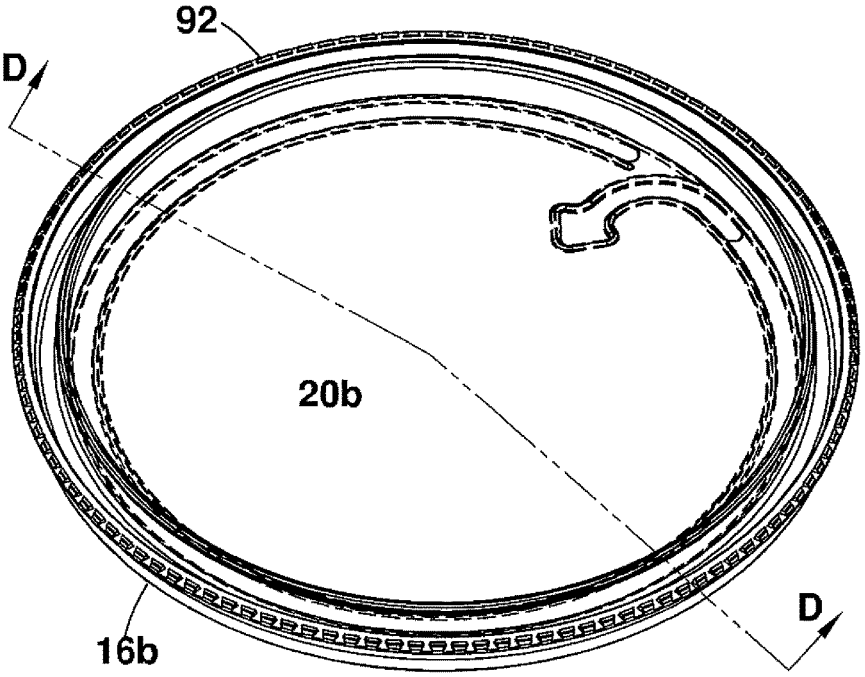
FIG. 8 is a perspective view of a base in accordance with an alternate embodiment of the invention, presenting teeth on the circumference of the base.
Figure 8A:
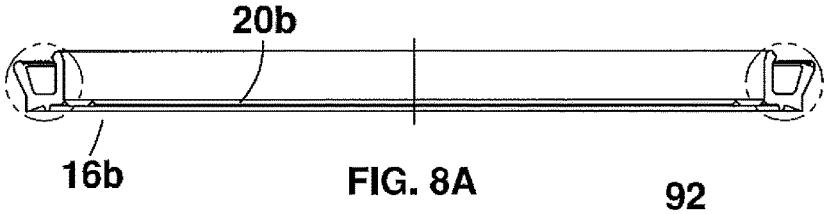
FIG. 8A is a section view of the base of FIG. 8 taken along line D-D.
Figure 8B:
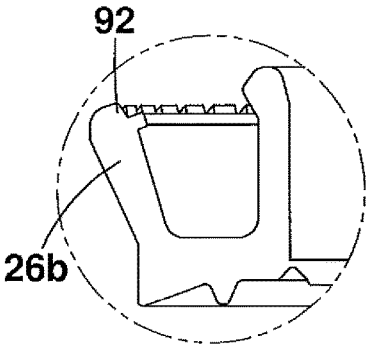
FIG. 8B is a close up sectional view of the portion marked in chain-dot circle on the left-hand side of FIG. 8A, showing the cross-section of the base through one of the teeth.
Figure 8C:
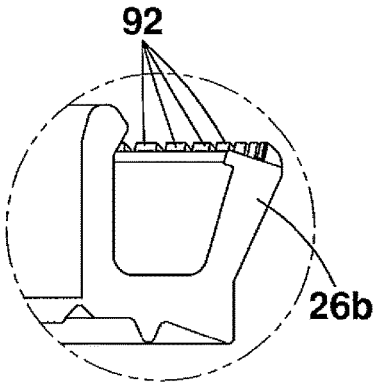
FIG. 8C is a close up sectional view of the portion marked in chain-dot circle on the right-hand side of FIG. 8A, showing the cross-section of the base through a gap between adjacent teeth.
Figure 9:
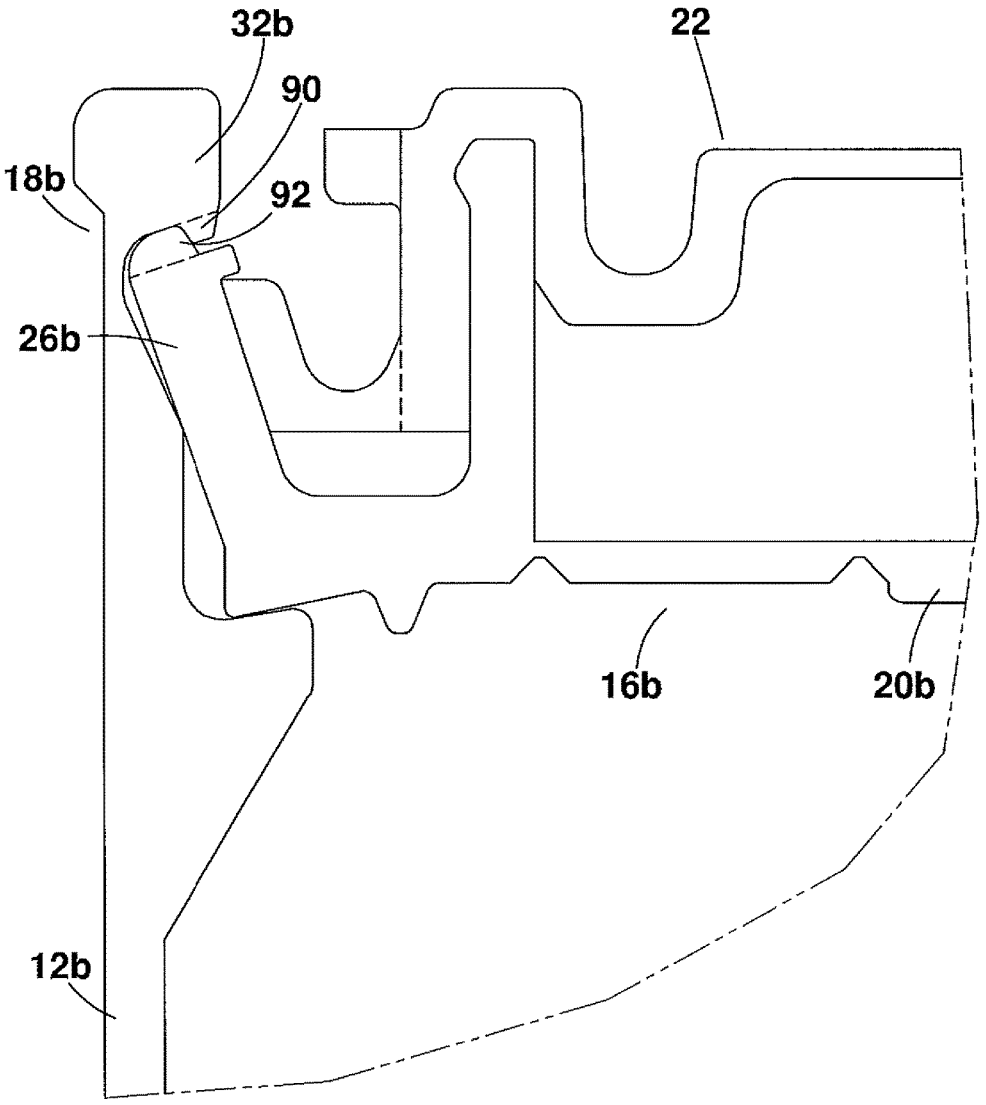
FIG. 9 is a cross-sectional close up view of the point of attachment of the lid, base and rim of container in accordance with the alternate embodiment of invention of FIG. 7 through 8C.
Figure 10A:
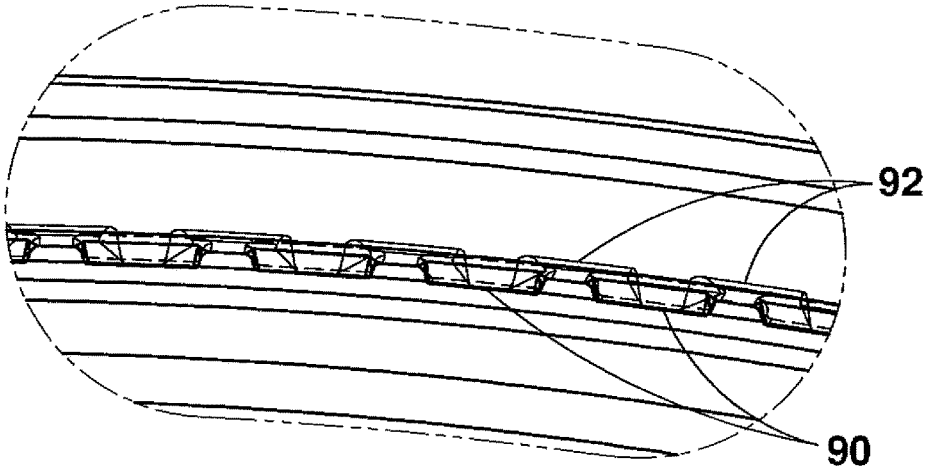
FIG. 10A is a close up view of the portion of FIG. 10 marked in chain-dot circle, showing the placement of the teeth of the container against those of the base when container and base are secured together.
Figure 10:
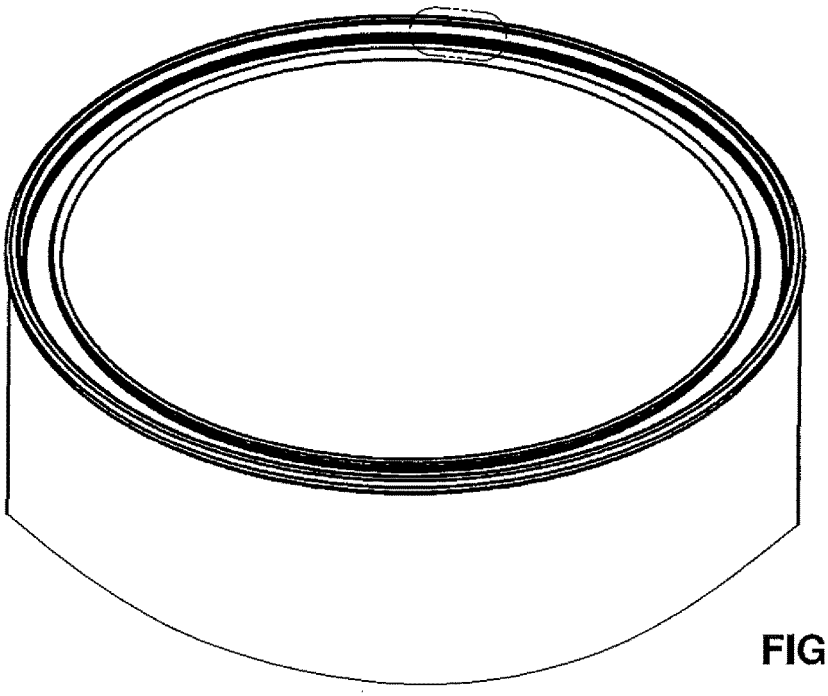
FIG. 10 is a perspective view of the container and base of FIGS. 7 and 8, showing the base secured to the container.

Shown in FIG. 7 and in the close up view of FIG. 7A is an alternate embodiment of the container 10*b*, having an upper extending tubular wall element 12*b* presenting a plurality of teeth 90 disposed inwardly and downwardly on an annular inward facing upper bead 32*b* of the upper rim 18*b* of the container. Shown in FIG. 8 is an alternate embodiment of the base 16*b* for use with container 10*b*, base 16*b* having a plurality of teeth 92 on the upper circumference of an outwardly directed resilient exterior annular wall 26*b*. As seen in FIG. 10A, teeth 90 are designed such that they snap over teeth 92 when the base is attached to the upper rim of the container, with teeth 92 engaging upward and outward over mating teeth 90, causing a positive retention of the outwardly directed resilient exterior annular wall 26*b* within the mating annular inward cavity extending around the rim 18*b* of the container 10*b*. This alternate embodiment of container and base, adapted for use with the lid 22 of FIGS. 3 and 3A, creates a further strengthened closure envisioned for use with highly stringent drop test applications. The features of FIG. 7 through FIG. 9 may be present in addition or alternate to those of the container assembly of alternate embodiments, such as for example the base without tamper-evident panel.

A further embodiment contemplated by this invention presents a container where teeth 90 are replaced by a continuous, downwardly facing ridge (with the same cross-section as teeth 90), and a matching base where teeth 92 are replaced by a continuous, upwardly-disposed ridge (with the same cross-section as teeth 92). It should be understood that a container with continuous downwardly facing ridge may be used with a base with teeth 92; that a container with teeth 90 may be used with a base with continuous upwardly disposed ridge; and that a container with continuous downwardly facing ridge may be used with a base with continuous upwardly disposed ridge.

While the disclosure has been described with reference to example embodiment(s), it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A container and lid assembly comprising:

a container including an upper extending tubular wall element extending from a perimeter of a bottom wall to an upper rim at an upper portion thereof defining an interior containing space, the upper rim including a reduced thickness area forming an annular inward facing cavity, the upper portion of the tubular wall element including an annular inward facing upper bead positioned above the annular inward facing cavity;

a base including an annular portion having an outwardly directed resilient exterior annular wall which is positionable within the annular inward facing cavity of the upper rim of the tubular wall element in snap fit engagement, securing the base to the upper extending tubular wall element, the annular portion of the base including an upward facing annular groove extending around an entirety thereof, the upward facing annular groove bounded by the outwardly directed exterior annular wall and an interior upright wall; and a lid including a plurality of spaced apart resilient flange elements extending outwardly from a bottom portion of an annular portion of the lid, the flange elements snap fit engageable within the upward facing annular groove of the base, the flange elements in contact with the outwardly directed resilient exterior wall and the interior upright wall of the base.

2. The assembly of claim 1 wherein the upward facing annular groove of the base is defined by an interior upright wall, a bottom wall and an obtusely angled exterior wall, the exterior wall including an inward bead extending around the upper end thereof and each flange element of the lid has a bottom portion which extends outwardly from a circumferential edge of the lid and an upwardly extending resilient slightly obtusely angled outer wall, and as the lid is pressed upon the annular portion of the base, the upwardly extending resilient outer wall of each flange element is deformed inwardly as it enters the top of the annular groove by the inward bead, and then once within the groove, returns back to its obtusely angular position thereby securing the lid in position within the groove.

3. The assembly of claim 2 wherein the inward bead extends continuously around an entirety of the upper end of the exterior wall.

4. The assembly of claim 2 wherein the inward bead extends inwardly from portions of the upper end of the exterior wall.

5. The assembly of claim 1 wherein the lid comprises a prying flange extending outwardly from an outer annular portion of the lid in at least one of the spaces between the flange elements.

6. The assembly of claim 1 wherein the upper portion of the tubular wall element of the container includes an inward facing ledge upon which a bottom portion of the exterior annular wall of the base locates when the exterior annular wall of the base is snap fit into engagement within the annular inward facing cavity in the tubular wall element of the container.

7. The assembly of claim 6 wherein the ledge comprises an upwardly angled molded flexible wiper protuberance extending inwardly therefrom wherein the flexible wiper protuberance on the ledge engages with a portion of the exterior annular wall of the base, when in said snap fit engagement, said wiper protuberance creating a seal to act as barrier to prevent the contents of the interior containing space of the container from leaking between the rim of the container and base panel.

8. The assembly of claim 7 further comprising a second flexible wiper protuberance positioned on or adjacent said ledge, which when in said snap fit engagement flexes against the exterior wall of the base, providing a further barrier to prevent contents of the interior containing space from leaking.

9. The assembly of claim 1 wherein the lid, container and base comprise thermoplastic material.

10. The assembly of claim 1 wherein the base includes a continuous interior horizontal panel covering the entirety of the container when the base is secured upon the container.

11. The assembly of claim 10 wherein the interior horizontal panel includes a circumferential tear strip defined by lines of reduced thickness and extends around the perimeter of the interior horizontal panel, inward and adjacent to the annular portion.

12. The assembly of claim 1 wherein the lid is transparent.

13. The assembly of claim 1 wherein the base includes a central opening.

14. The assembly of claim 5 wherein the lid includes a plurality of flange elements and a plurality of prying flanges with the spacing of the flange elements being such that the distance between consecutive flanges is approximately the same as the length of each flange.

15. The assembly of claim 1 wherein the upper extending tubular wall element of the container presents a plurality of teeth disposed inwardly and downwardly on the annular inward facing upper bead of the upper rim of the tubular wall element of the container positioned above the inward facing cavity in the upper rim of the tubular wall element; the base including a plurality of teeth on the upper circumference of the outwardly directed resilient exterior annular wall thereof, wherein when annular wall of the base is positioned within the inward facing cavity in the upper rim of the tubular wall element, the teeth on the rim engage and overlap with the teeth on the exterior annular wall of the base, further strengthening the attachment between container and base.

16. The assembly of claim 1 wherein the upper extending tubular wall element of the container presents a ridge disposed inwardly and downwardly on the annular inward facing upper bead of the upper rim of the tubular wall element of the container positioned above the inward facing cavity in the upper rim of the tubular wall element; the base including a ridge on the upper circumference of the outwardly directed resilient exterior annular wall thereof, wherein when annular wall of the base is positioned within the inward facing cavity in the upper rim of the tubular wall element, the ridge on the rim engages and overlaps with the ridge on the exterior annular wall of the base, further strengthening the attachment between container and base.

17. The assembly of claim 1 wherein the upper extending tubular wall element of the container presents a plurality of teeth or a continuous ridge disposed inwardly and downwardly on the annular inward facing upper bead of the upper rim of the tubular wall element of the container positioned above the inward facing cavity in the upper rim of the tubular wall element; the base including a plurality of teeth or a continuous ridge on the upper circumference of the outwardly directed resilient exterior annular wall thereof, wherein when annular wall of the base is positioned within the inward facing cavity in the upper rim of the tubular wall element, the teeth or ridge on the rim engage engages and overlap overlaps with the teeth or ridge on the exterior annular wall of the base, further strengthening the attachment between container and base.

18. The assembly of claim 1 wherein as the outwardly directed resilient exterior annular wall of the base enters the annular inward facing cavity in the upper rim of the tubular wall element, the inward facing upper bead deforms the exterior annular wall inwardly and as the exterior annular wall of the base enters the annular inward facing cavity in snap fit engagement, the exterior annular wall returns to its normal position.

19. A container and lid assembly comprising:

a container including an upper extending tubular wall element extending from a perimeter of a bottom wall to an upper rim at an upper portion thereof defining an interior containing space, the upper rim including a reduced thickness area forming an annular inward facing cavity, the upper portion of the tubular wall element including an annular inward facing upper bead positioned above the annular inward facing cavity;

a base including an annular portion having an outwardly directed resilient exterior annular wall which is positionable within the annular inward facing cavity of the upper rim of the tubular wall element in a first snap fit engagement, securing the base to the upper extending tubular wall element, the annular portion of the base including an upward facing annular groove extending around an entirety thereof, the upward facing annular groove bounded by the outwardly directed resilient exterior annular wall and an interior upright wall; and a lid including a plurality of spaced apart resilient flange elements extending outwardly from a bottom portion of an annular portion of the lid, the flange elements configured to form a second snap fit engagement within the upward facing annular groove of the base, the flange elements in contact with the outwardly directed resilient exterior annular wall and the interior upright wall of the base.

* * * * *